US008819977B2

(12) United States Patent
Corso

(10) Patent No.: US 8,819,977 B2
(45) Date of Patent: Sep. 2, 2014

(54) COMPACT FIREARM SPRING ARRANGEMENT

(71) Applicant: Steven Corso, Jupiter, FL (US)

(72) Inventor: Steven Corso, Jupiter, FL (US)

( * ) Notice: Subject to any disclaimer, the term of this patent is extended or adjusted under 35 U.S.C. 154(b) by 81 days.

(21) Appl. No.: 13/747,819

(22) Filed: Jan. 23, 2013

(65) Prior Publication Data

US 2014/0020275 A1 Jan. 23, 2014

Related U.S. Application Data

(60) Provisional application No. 61/589,903, filed on Jan. 24, 2012.

(51) Int. Cl.
*F41A 9/71* (2006.01)
*F41A 9/65* (2006.01)
*F41A 9/70* (2006.01)

(52) U.S. Cl.
CPC ..... *F41A 9/70* (2013.01)
USPC ..... 42/49.01; 42/49.02; 42/50

(58) Field of Classification Search
CPC ..... F41A 9/61; F41A 9/64; F41A 9/65; F41A 9/67; F41A 9/69; F41A 9/71; F41A 9/72
USPC ..... 42/6, 7, 17, 18, 21, 22, 24, 29, 33, 35, 42/37, 39, 49.01, 49.02, 50; 89/33.01, 89/33.1
See application file for complete search history.

(56) References Cited

U.S. PATENT DOCUMENTS

| | | | | | |
|---|---|---|---|---|---|
| 889,243 | A * | 6/1908 | Langdon. | 42/17 |
| 2,620,581 | A * | 12/1952 | Fiorini | 42/49.01 |
| 3,165,852 | A * | 1/1965 | Into | 42/49.01 |
| 4,495,720 | A * | 1/1985 | Bross | 42/7 |
| 5,113,605 | A * | 5/1992 | Kim | 42/50 |
| 5,495,687 | A * | 3/1996 | Waiser | 42/50 |
| 6,055,758 | A * | 5/2000 | Vieweg | 42/7 |
| 6,094,850 | A * | 8/2000 | Villani | 42/1.02 |
| 7,200,964 | B2 * | 4/2007 | Gates | 42/50 |
| 8,572,877 | B2 * | 11/2013 | Sullivan | 42/50 |
| 8,607,489 | B1 * | 12/2013 | Calvert | 42/49.01 |
| 2005/0188579 | A1 * | 9/2005 | Gates | 42/50 |
| 2010/0126053 | A1 * | 5/2010 | Fitzpatrick et al. | 42/50 |

* cited by examiner

*Primary Examiner* — Bret Hayes
*Assistant Examiner* — Derrick Morgan
(74) *Attorney, Agent, or Firm* — Robert M. Downey, P.A.

(57) ABSTRACT

A compact firearm spring arrangement within a firearm magazine utilizes two or more springs connected in a linear arrangement by a connecting cup that allows one spring to compress within the other, thereby resulting in a free length spring system having a reduced height when fully compressed while maintaining sufficient force for operation of the firearm. The reduced height of the spring when fully compressed allows for additional bullet storage space within a magazine of standard size or, alternatively, a more compact system within a magazine that provides an equal amount of bullet storage space while reducing the friction of operation of the firearm.

15 Claims, 3 Drawing Sheets

COMPACT FIREARM SPRING ARRANGEMENT

This patent application is based on provisional patent application Ser. No. 61/589,903 filed on Jan. 24, 2012.

BACKGROUND OF THE INVENTION

1. Field of the Invention

The present invention relates to a magazine for use in automatic and semiautomatic firearms and, more particularly, to an improved spring arrangement within a magazine that allows for increased storage space of ammunition bullets.

2. Discussion of the Related Art

A standard magazine (i.e. ammunition storage and feeding device attached to a repeating firearm) utilizes a single oval spring to displace the stored bullets of ammunition after a firearm action. Due to the length and force required for operation of the firearm, a conical-style spring cannot be used in a magazine. Therefore, the approximate height of a fully compressed oval spring is typically equal to the spring wire diameter multiplied by the number of winds in the spring.

Firearms, particularly pistols, are often miniaturized for decreased visibility when being carried. Typical compact firearms are designed to sacrifice bullet capacity in order to achieve sufficient miniaturization. However, whether the firearm is miniaturized or not, it is often desirable for the firearm magazine to house as many bullets as possible while maintaining as small a size as possible.

Additionally, firearm magazines are often difficult to load due to the increase in spring pressure as each bullet is loaded into the magazine. High spring pressure when fully loaded can also cause excessive friction as the slide on an automatic pistol returns to battery after being fired, which can prevent the slide from completely returning to its firing position.

In view of the shortcomings associated with existing firearm magazines, there is a need for an improved magazine design that utilizes a spring arrangement that allows for more bullet storage within the same amount of space typically provided in a magazine and which reduces the friction of operation of the firearm.

SUMMARY OF THE INVENTION

The present invention is directed to an improved spring arrangement within a firearm magazine which utilizes a primary spring and one or more secondary springs connected in a linear arrangement by a connecting cup that allows each secondary spring to compress within the primary spring, thereby resulting in a free length spring system having a reduced height when fully compressed while maintaining sufficient force for operation of the firearm. The reduced height of the spring system when fully compressed allows for additional bullet storage space within a magazine of standard size or, alternatively, a more compact system that provides an equal amount of bullet storage space while reducing the friction of operation of the firearm.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENTS

Figure 1:
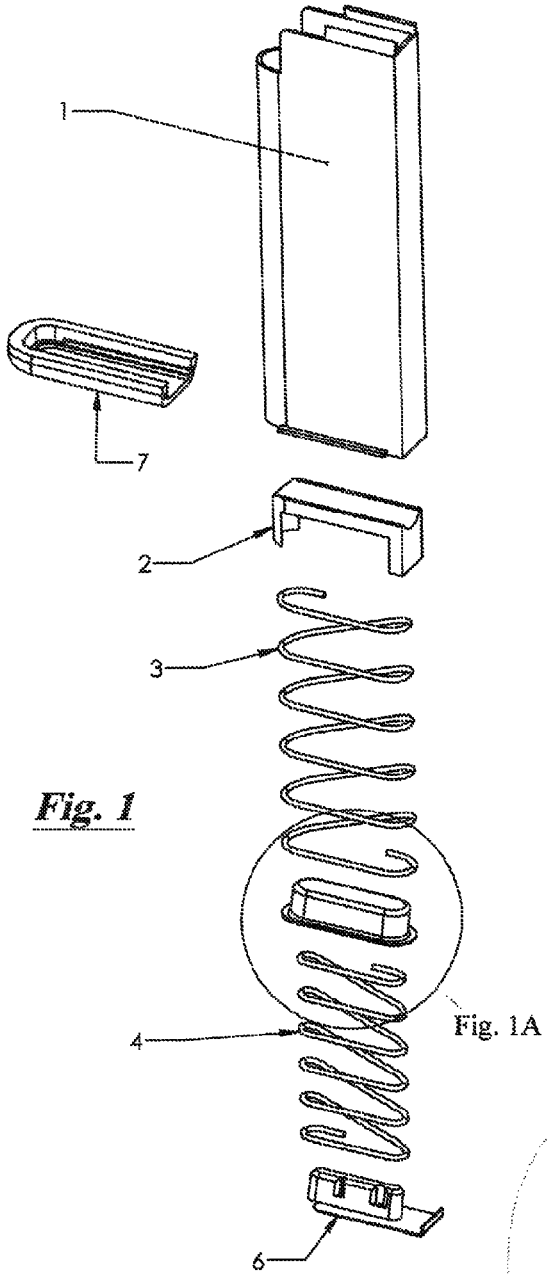
FIG. 1 is an exploded view of the magazine.
Figure 2:
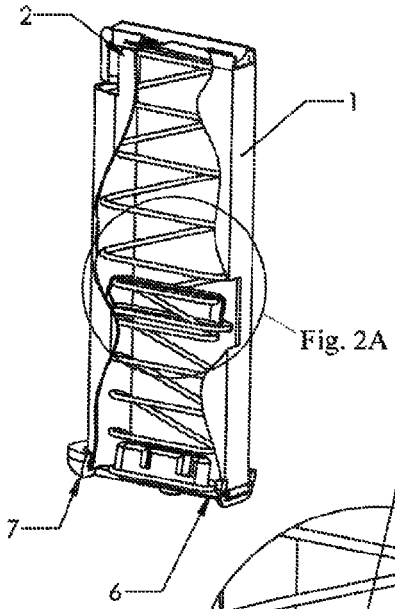
FIG. 2 is a perspective view of an assembled magazine, shown in cross-section.
Figure 2A:
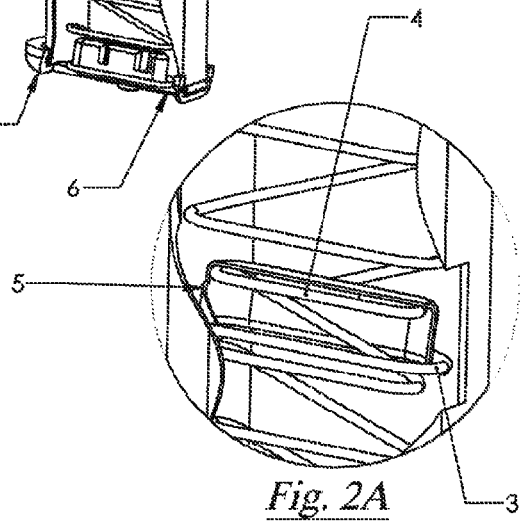
FIG. 2A is a magnified view taken from FIG. 2 of the connecting cup and primary and secondary compression springs.

Referring to the several views of the drawings, the compact firearm spring arrangement of the present invention is shown and generally indicated as 10.

A hollow, generally rectangular-shaped magazine tube 1 includes a follower 2, a primary compression spring 3, a secondary compression spring 4, and a spring connecting cup 5. The bottom end of the tube 1 is closed by an integrally connected or removable bottom plate 7. The tube 1 defines an interior chamber sized for storing bullets 8 for use by a firearm. Where the bottom plate 7 is removable, as shown in FIGS. 1-3A, a lock plate 6 is used for preventing the bottom plate 7 from inadvertently sliding off the magazine tube 1. The tube 1, follower 2, and spring connecting cup 5 may each be formed of metal, plastic, or any other suitable material. Primary and secondary compression springs 3 and 4 may be formed of materials commonly known in the art, such as music wire.

Figure 1A:
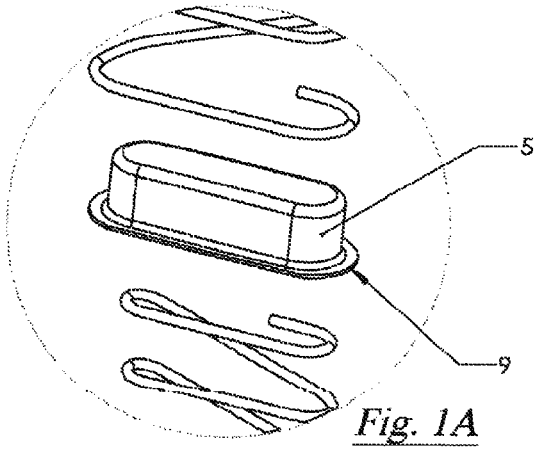
FIG. 1A is a magnified view taken from FIG. 1 of the connecting cup.

Referring to FIGS. 1 and 1A, the follower 2 is shaped generally as an oblong piston that can move within the interior chamber of the tube 1. The follower 2 serves to support a bullet 8 in position to be loaded into the chamber of a firearm. The underside of the base of the follower 2 is hollowed out or, in the alternative, may be flat. The primary spring 3 is wound in an oblong-shaped coil and includes a first end located under the follower 2. The opposite second end of the primary spring 3 is seated in the outer rim 9 of spring connecting cup 5.

Referring to FIGS. 1-4, a preferred embodiment of the spring connecting cup 5 is semi-tubular shaped with an outside diameter slightly smaller than the inside of the primary spring 3 and an inside diameter slightly larger than the secondary spring 4. The depth of the connecting cup 5 is approximately equal to the height of the primary spring 3 in the fully compressed state. Therefore, when fully compressed, the secondary compression spring 4 and the connecting cup 5 are located within the hollow interior channel formed by the coiled wire of the primary compression spring 3.

The spring connecting cup 5 includes a flange partially closing the top end and extending downwards to form the wall of the connecting cup 5. The opposite bottom end of the spring connecting cup 5 includes an outer rim 9 extending outwardly from the wall which is sized to snuggly receive the wire of one end of the primary spring 3. The connecting cup 5 receives the wire at the first bend in the primary spring 3, while the second bend of the wire is received on the opposite side of the connecting cup 5, and the connecting cup 5 is sized and configured to enter the interior channel of the primary spring 3 when the spring arrangement 10 is compressed.

Figure 5:
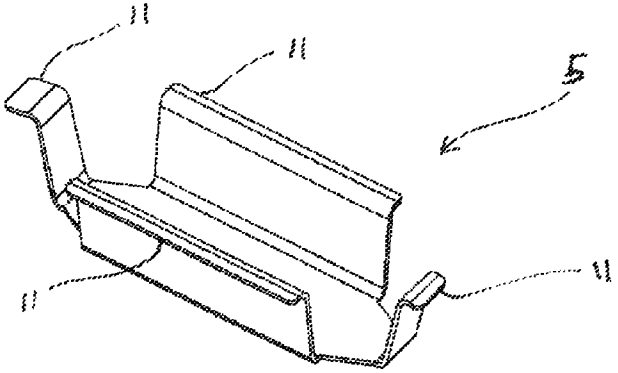
FIG. 5 is an isolated perspective view of an alternative embodiment of the connecting cup.

Referring to FIG. 5, an alternative embodiment of the connecting cup 5 is shown, and includes flanged prongs 11 extending from the base of the connecting cup 5. Longer or shorter flanged prongs 11 may be used to position the connecting cup 5 within the magazine tube as required. The flanged prongs 11 are preferably made from spring steel, or other similar material, which will permit the prongs 11 to bend inwards in order to engage the interior channel of a spring 3. Importantly, the multiple flanged prong embodiment of the connecting cup 5 permits the use of slightly oversized or undersized springs in combination with a particularly sized magazine tube 1, as the prongs 11 can bend inwards in order to engage the interior channel of a particularly sized spring and allow the spring to snap into the outer rim 9 for securing the spring to the connecting cup 5.

Figure 6:
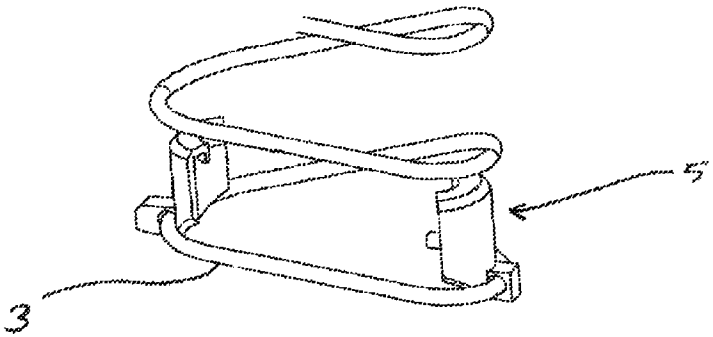
FIG. 6 is an isolated perspective view of an alternative embodiment of the connecting cup.
Figure 4:
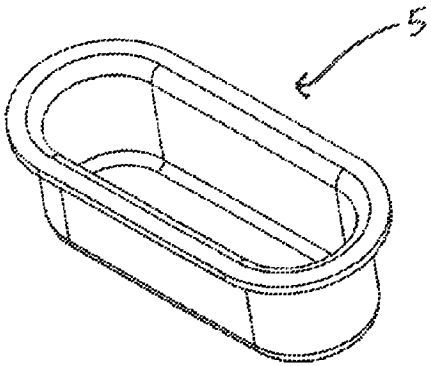
FIG. 4 is an isolated perspective view of a preferred embodiment of the connecting cup.

Referring to FIG. 6, a second alternative embodiment of the connecting cup 5 includes a generally rectangular-shaped protrusion including a cross drilled hole extending through the length of the protrusion and sized to snuggly receive the a portion of the coiled wire for holding the primary spring 3 in place within the magazine tube 1.

The secondary spring 4 is wound up into an oblong shape that is slightly smaller than the inside diameter of the spring connecting cup 5. The secondary spring 4 is received within the interior compartment of the connecting cup 5 through the bottom end when the spring arrangement 10 is compressed, and maintains contact with the interior compartment of the closed, flanged ends of the connecting cup 5 due to the spring rate force of the secondary spring 4. As illustrated in FIGS. 1-3A, the lower end of the secondary compression spring 4 is in contact with the closed inside end of the tube 1 or bottom plate 7. A lock plate 6 may be used to secure the lower end of the secondary spring 4, wherein screws or other securing mechanisms are used to secure the spring 4 to the bottom plate 7, which prevents a removable lock plate 7 from being inadvertently removed.

Figure 3:
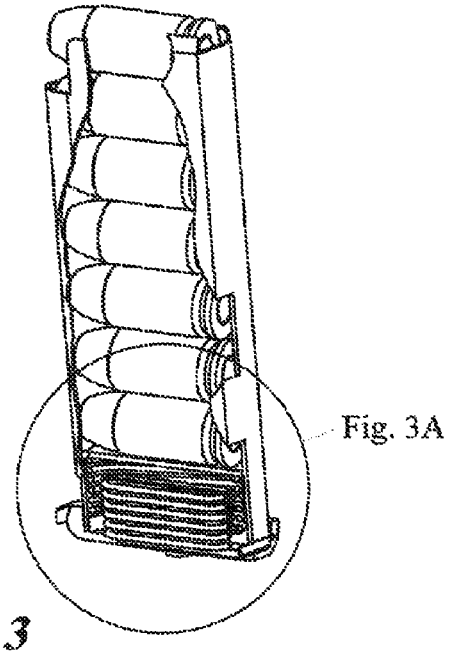
FIG. 3 is a perspective view of a loaded magazine, shown in cross-section.
Figure 3A:
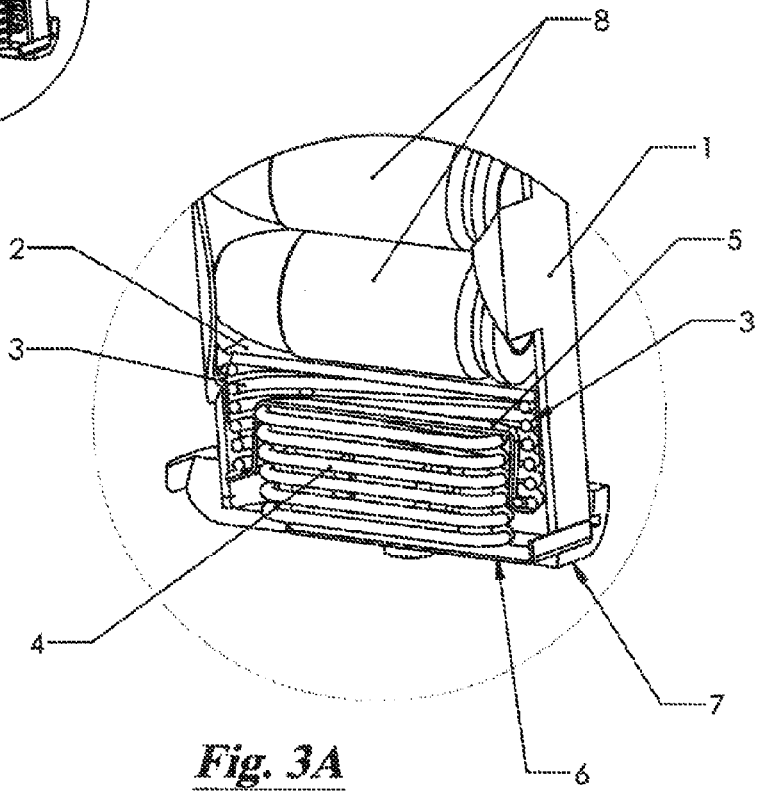
FIG. 3A is a magnified view taken from FIG. 3 of the connecting cup and primary and secondary compression springs.

When the magazine is unloaded, the compression springs 3 and 4 are slightly compressed to provide adequate force on the first bullet 8 to be loaded. There is a slight overlap between the bottom end of the primary spring 3 and the top end of the secondary spring 4 as a result of the offset caused by the connecting cup 5. In operation, with each bullet 8 that is loaded, both the primary spring 3 and secondary spring 4 compress together until the magazine is fully loaded. In its fully loaded state, the primary spring 3 and secondary spring 4 may be completely compressed to approximately the same height, with the secondary spring 4 residing within the interior compartment of the connecting cup 5 and the connecting cup 5 residing within the hollow interior channel of the primary spring 3, as shown in FIGS. 3 and 3A.

A three compression spring configuration (not shown in the drawings) allows for a more compact arrangement wherein a third spring resides within the secondary spring 4 when fully compressed. In a three spring configuration, the lower end of the secondary spring 4 receives a secondary connecting cup 5 that is slightly smaller in size than the inside of the secondary spring 4. The secondary connecting cup 5 receives the secondary spring 4 in the same manner as the first connecting cup 5 receives the primary spring 3. A third compression spring is wound in an oblong shape slightly smaller than the inside diameter of the secondary connecting cup 5. The third compression spring is received within the inside of the secondary connecting cup 5 and is in contact with the closed flanged ends in the bottom of the secondary connecting cup 5. The lower end of the third compression spring is in contact with the closed inside end of the tube 1 or bottom plate 7.

Using multiple spring arrangements, as described above, permits a degree of flexibility in regards to the spring force exerted on the bullets 8 by the primary spring 3 and secondary spring 4 at certain combined lengths (variable according to the number of bullets in the magazine), as each individual spring can have a unique spring rate, thereby allowing the spring system to accurately target specific spring rates at particular heights. The limit on the number of possible springs used in the spring arrangement 10 is dependent on the amount of space remaining as the compression springs 3 and 4 and connecting cups 5 get smaller.

While the present invention has been shown and described in accordance with several preferred and practical embodiments, it is recognized that departures from the instant disclosure and fully contemplated within the spirit and scope of the present invention which is not to be limited except as defined in the following claims as interpreted under the Doctrine of Equivalence.

What is claimed is:

1. A magazine for storing bullets for use by a firearm, said magazine comprising:

a tube defining an interior chamber of the magazine, said tube having a bottom plate and an open top, and said tube being sized and configured for storing at least one bullet in position for use by the firearm;

a follower for supporting said at least one bullet in position to be loaded into the chamber of the firearm, and said follower being sized and configured to move within the interior chamber;

a primary compression spring formed from a coiled wire having a first end and a second end, the first end being in communication with said follower, and said primary compression spring being structured and disposed for compressing when a bullet is inserted into said tube and expanding when a bullet exits said tube;

at least one secondary compression spring formed from a coiled wire having a first end and a second end, the first end being in communication with the bottom plate of said tube, said at least one secondary compression spring having a smaller diameter than the diameter of said primary compression spring, and said at least one secondary compression spring being structured and disposed for compressing when a bullet is inserted into said tube and expanding when a bullet exits said tube;

a connecting cup having an interior compartment surrounded by an outer rim extending from the base of said connecting cup, and said connecting cup being structured and disposed for securing the second end of said primary compression spring against the outer rim of said connecting cup and the second end of said at least one secondary compression spring in the interior compartment of said connecting cup;

said at least one secondary compression spring being compressible within the compartment of said connecting cup and said connecting cup fitting within the hollow interior channel formed by the coiled wire of said primary compression spring; and wherein the outer rim of said connecting cup comprises a plurality of flanged prongs extending from the base of said connecting cup and surrounding the interior compartment of said connecting cup, and said plurality of flanged prongs engaging the hollow interior channel of said primary compression spring until the second end of said primary compression spring snaps into the outer rim of said connecting cup.

2. The magazine for storing bullets for use by a firearm as recited in claim 1 wherein said bottom plate is removable.

3. The magazine for storing bullets for use by a firearm as recited in claim 2 further comprising a lock plate integrally attached to said removable bottom plate, and said lock plate being provided for secured attachment to the first end of said secondary compression spring.

4. The magazine for storing bullets for use by a firearm as recited in claim 1 wherein said plurality of flanged prongs are structured and disposed for bending inwards when engaging the hollow interior channel of said primary compression spring.

5. The magazine for storing bullets for use by a firearm as recited in claim 4 wherein each of said plurality of flanged prongs are formed of spring steel.

6. The magazine for storing bullets for use by a firearm as recited in claim 1 wherein said primary compression spring and said at least one secondary compression spring have unique spring rates.

7. The magazine for storing bullets for use by a firearm as recited in claim 1 wherein said primary compression spring and said at least one secondary compression spring have equal spring rates.

8. A spring arrangement for use in the interior chamber of a firearm magazine, said spring arrangement comprising:

a follower for supporting at least one bullet in position to be loaded into the chamber of the firearm, and said follower being sized and configured to move within the interior chamber of the firearm magazine;

a primary compression spring formed from a coiled wire having a first end and a second end, the first end being in communication with said follower, and said primary compression spring being structured and disposed for compressing when a bullet is inserted into the firearm magazine and expanding when a bullet exits the firearm magazine;

at least one secondary compression spring formed from a coiled wire having a first end and a second end, the first end being in communication with the bottom of the interior chamber of the firearm magazine, said at least one secondary compression spring having a smaller diameter than the diameter of said primary compression spring, and said at least one secondary compression spring being structured and disposed for compressing when a bullet is inserted into the firearm magazine and expanding when a bullet exits the firearm magazine;

a connecting cup having an interior compartment surrounded by an outer rim extending from the base of said connecting cup, and said connecting cup being structured and disposed for securing the second end of said primary compression spring against the outer rim of said connecting cup and the second end of said at least one secondary compression spring in the interior compartment of said connecting cup; and said at least one secondary compression spring being compressible with the compartment of said connecting cup and said connecting cup fitting within the hollow interior channel formed by the coiled wire of said primary compression spring; and wherein the outer rim of said connecting cup comprises a plurality of flanged prongs extending from the base of said connecting cup and surrounding the interior compartment of said connecting cup, and said plurality of flanged prongs engaging the hollow interior channel of said primary compression spring until the second end of said primary compression spring snaps into the outer rim of said connecting cup.

9. The spring arrangement for use in the interior chamber of a firearm magazine as recited in claim 8 said plurality of flanged prongs are structured and disposed for bending inwards when engaging the hollow interior channel of said primary compression spring.

10. The spring arrangement for use in the interior chamber of a firearm magazine as recited in claim 9 wherein each of said plurality of flanged prongs are formed of spring steel.

11. The spring arrangement for use in the interior chamber of a firearm magazine as recited in claim 8 wherein said primary compression spring and said at least one secondary compression spring have unique spring rates.

12. The spring arrangement for use in the interior chamber of a firearm magazine as recited in claim 8 wherein said primary compression spring and said at least one secondary compression spring have equal spring rates.

13. A spring arrangement for use in the interior chamber of a firearm magazine, said spring arrangement comprising: a follower for supporting at least one bullet in position to be loaded into the chamber of the firearm, and said follower being sized and configured to move within the interior chamber of the firearm magazine;

a primary compression spring formed from a coiled wire having a first end and a second end, the first end being in communication with said follower, and said primary compression spring being structured and disposed for compressing when a bullet is inserted into the firearm magazine and expanding when a bullet exits the firearm magazine;

at least one secondary compression spring formed from a coiled wire having a first end and a second end, the first end being in communication with the bottom of the interior chamber of the firearm magazine, said at least one secondary compression spring having a smaller diameter than the diameter of said primary compression spring, and said at least one secondary compression spring being structured and disposed for compressing when a bullet is inserted into the firearm magazine and expanding when a bullet exits the firearm magazine;

a connecting cup having an interior compartment surrounded by a protrusion including a cross drilled hole extending through the length of the protrusion, and said connecting cup being structured and disposed for securing the second end of said primary compression spring in the cross drilled hole of said connecting cup and the second end of said at least one secondary compression spring in the interior compartment of said connecting cup; and said at least one secondary compression spring being compressible within the compartment of said connecting cup and said connecting cup fitting within the hollow interior channel formed by the coiled wire of said primary compression spring; and wherein the outer rim of said connecting cup comprises a plurality of flanged prongs extending from the base of said connecting cup and surrounding the interior compartment of said connecting cup, and said plurality of flanged prongs engaging the hollow interior channel of said primary compression spring until the second end of said primary compression spring snaps into the outer rim of said connecting cup.

14. The spring arrangement for use in the interior chamber of a firearm magazine as recited in claim 13 wherein said primary compression spring and said at least one secondary compression spring have unique spring rates.

15. The spring arrangement for use in the interior chamber of a firearm magazine as recited in claim 13 wherein said primary compression spring and said at least one secondary compression spring have equal spring rates.

* * * * *